United States Patent [19]

Jackson et al.

[11] 4,003,742

[45] Jan. 18, 1977

[54] VELOCITY COMPENSATION FOR BEAD BYPASS WITH SPEED REDUCTION

[75] Inventors: Earl V. Jackson, Penfield; Roger G. Teumer, Fairport; LeRoy Baldwin, Rochester, all of N.Y.

[73] Assignee: Xerox Corporation, Stamford, Conn.

[22] Filed: Nov. 17, 1975

[21] Appl. No.: 632,435

Related U.S. Application Data

[62] Division of Ser. No. 476,185, June 4, 1974, Pat. No. 3,950,088.

[52] U.S. Cl. ..... 96/1 PE; 96/1.3 EC; 204/181; 204/299 EC; 204/300 EC; 355/3 P; 355/17

[51] Int. Cl.[2] ..... G03G 15/24

[58] Field of Search ..... 96/1 PE, 1.3; 355/3 P; 204/181 PE, 299 PE, 300 PE

[56] References Cited

UNITED STATES PATENTS 3,825,724 7/1974 Kingsley et al. ..... 219/469

*Primary Examiner*—David Klein
*Assistant Examiner*—Judson R. Hightower
*Attorney, Agent, or Firm*—James J. Ralabate; Michael H. Shanahan; Charles E. Smith

[57] ABSTRACT

A system employing at least one separation roller continuously contacting the outside surface of a web and tracked to move in a fixed approximately elliptical path, for compensating for web motion during separation of the web from another surface to enable a bead of accumulated material built up at the line of contact between the web and the other surface to pass therebetween without changing the web velocity. During the separation period, the advancing velocity of at least one surface is reduced so that at least one surface is advanced at a slower rate than its rate prior to separation, or stopped. In a preferred embodiment, the system is employed in photoelectrophoretic imaging to bypass a bead of imaging suspension built up at the imaging nip during separation of two webs immediately after completion of imaging to thereby permit dissipation or passage of the liquid bead without changing the advancing web velocity by reason of the separation operation. During the separation period, the surface, preferably a web, which does not carry the desired image, is advanced at a slower rate than its prior rate and slower than the other surface, or stopped.

5 Claims, 6 Drawing Figures

VELOCITY COMPENSATION FOR BEAD BYPASS WITH SPEED REDUCTION

This is a division of application Ser. No. 476,185, filed June 4, 1974, now U.S. Pat. No. 3,950,088.

BACKGROUND OF THE INVENTION

This invention relates in general to accumulated material bead bypass and web control systems and, more particularly, their use in an improved photoelectrophoretic imaging system.

In the photoelectrophoretic imaging process, monochromatic including black and white or full color images are formed through the use of photoelectrophoresis. An extensive and detailed description of the photoelectrophoretic process is found in U.S. Pat. Nos. 3,384,488 and 3,384,565 to Tulagin and Carreira; 3,383,993 to Yeh and 3,384,566 to Clark, which disclose a system where photoelectrophoretic particles migrate in image configuration providing a visual image at one or both of two electrodes between which the particles suspended within an insulating carrier is placed. The particles are electrically photosensitive and are believed to bear a net electrical charge while suspended which causes them to be attracted to one electrode and apparently undergo a net change in polarity upon exposure to activating electromagnetic radiation. The particles will migrate from one of the electrodes under the influence of an electric field through the liquid carrier to the other electrode.

The photoelectrophoretic imaging process is either monochromatic or polychromatic depending upon whether the photosensitive particles within the liquid carrier are responsive to the same or different portions of the light spectrum. A full-color polychromatic system is obtained, for example, by using cyan, magenta and yellow colored particles which are responsive to red, green and blue light respectively.

In photoelectrophoretic imaging generally, and as employed in the instant invention, the important broad teachings in the following four paragraphs should be noted.

Preferably, as taught in the four patents referred to above, the electric field across the imaging suspension is applied between electrodes having certain preferred properties, i.e., an injecting electrode and a blocking electrode, and the exposure to activating radiation occurs simultaneously with field application. However, as taught in various of the four patents referred to above and Luebbe et al., U.S. Pat. No. 3,595,770; Keller et al., U.S. Pat. No. 3,647,659 and Carreira et al., U.S. Pat. No. 3,477,934; such a wide variety of materials and modes for associating an electrical bias therewith, e.g., charged insulating webs, may serve as the electrodes, i.e., the means for applying the electric field across the imaging suspension, that opposed electrodes generally can be used; and that exposure and electric field applying steps may be sequential. In preferred embodiments herein, one electrode may be referred to as the injecting electrode and the opposite electrode as the blocking electrode. This is a preferred embodiment description. The terms blocking electrode and injecting electrode should be understood and interpreted in the context of the above comments throughout the specification and claims hereof.

It should also be noted that any suitable electrically photosensitive particle may be used. Kaprelian, U.S. Pat. No. 2,940,847 and Yeh, U.S. Pat. No. 3,681,064 disclose various electrically photosensitive particles, as do the four patents referred to above.

In a preferred mode, at least one of the electrodes is transparent, which also encompasses partial transparency that is sufficient to pass enough electromagnetic radiation to cause photoelectrophoretic imaging. However, as described in Weigl, U.S. Pat. No. 3,616,390 both electrodes may be opaque.

Preferably, the injecting electrode is grounded and the blocking electrode is biased to provide the field for imaging. However, such a wide variety of variations in how the field may be applied can be used, including grounding the blocking electrode and biasing the injecting electrode, biasing both electrodes with different bias values of the same polarity, biasing one electrode at one polarity and biasing the other at an opposite polarity of the same or different value, that just applying sufficient field for imaging can be used.

The photoelectrophoretic imaging system disclosed in the above-identified patents may utilize a wide variety of electrode configurations including a transparent flat electrode configuration for one of the electrodes, a flat plate or roller for the other electrode used in establishing the electric field across the imaging suspension.

There has been recently developed a photoelectrophoretic imaging system which utilizes web materials, which optimally may be disposable. In this process, the desired, e.g., positive image, is formed on one of the webs and another web will carry away the negative or unwanted image. The positive image can be fixed to the web upon which it is formed, or the image transferred to a suitable backing such as paper. The web which carries the negative image can be rewound and later disposed of. In such photoelectrophoretic imaging system employing disposable webs, cleaning systems are not required.

In photoelectrophoretic imaging systems employing a web device configuration, it is desirable to remove any accumulation of excess liquid build-up at the line of contact between the web and the other surface (which may be a web) to prevent bead material, at the trailing edge of an image, from tailing or otherwise extending into web areas to be used for subsequent images and thereby degrading the quality of subsequent images.

Apparatus in which surfaces including web materials are moved into and out of intimate pressure engagement for processing of film is generally known. For example, U.S. Pat. No. 3,640,204 to Gordon discloses a web processing device in which a web containing a processing ingredient or solution is brought into pressure engagement with an exposed film to effect processing of the film. This patent is not concerned with the problems overcome by the present invention, e.g., eliminating accumulation of bead material at the line of contact between the web and surface.

A process for removing excess liquid developer from a photoconductive surface is the Pneumatic Assembly Liquid Removing method and apparatus disclosed by Smith et al in U.S. Pat. No. 3,741,643. In this pneumatic assembly liquid removing process, a system is provided wherein excess toner is removed from the photoconductive surface by means of apparatus that requires equipment that is expensive and complex in comparison with the instant invention.

In Mihajlov, U.S. Pat. No. 3,281,241, a bead of developer liquid is advanced across the surface of the imaging support member. There is no suggestion, however, for employing the techniques of the instant invention.

In earlier photoelectrophoretic apparatus which sometimes encounters this bead of accumulated material, Egnaczak, U.S. Pat. No. 3,673,632 and Riley, U.S. Pat. No. 3,686,035 provide a slot in one of the surfaces to collect a bead, the slot being periodically emptied, to solve a similar problem. However, it may be impossible or impractical to employ a similar arrangement when using relatively thin webs as the surfaces.

One system that provides a simple and economical method and apparatus to eliminate this tailing liquid problem, without the above noted disadvantages, is disclosed in the copending application Ser. No. 476,189, Bead Bypass by Herman A. Hermanson, filed on the same date and assigned to a common assignee. In this system, apparatus is employed to separate two surfaces to a spacing sufficient to allow accumulated bead material formed at the line of contact between the surfaces to pass therebetween. However, when separation occurs, there may be a change in web velocity due to corresponding changes in web length. This change is web velocity or web length may be reflected at other process steps that are being carried out contemporaneously in the system.

SUMMARY OF THE INVENTION

Accordingly, it is an object of this invention to remove accumulations of materials between moving surfaces without the above noted disadvantages.

Another object of this invention is to improve cleaning techniques and means for the development of images of imaging systems.

A further object of this invention is to improve systems for removing accumulations of materials between two members moving relative to each other cyclically and automatically.

Still another object of this invention is to prevent or eliminate accumulations of materials from interfering with further images of an imaging system.

Another object of this invention is to improve photoelectrophoretic imaging systems employing a web device by eliminating image defects caused by accumulation of excess liquid beads, at the line of contact between electrodes.

Yet another object is to provide a photoelectrophoretic web imaging system using a minimum amount of web material.

Yet another object of this invention is to permit bead bypass by separating or nearly separating two surfaces, one of which is a web, without changing the advancing velocity of said web during the separating or recontacting operation to permit, e.g., said web to be advanced at a constant velocity so that processing steps either prior to or subsequent to the separation and recontacting operation are not adversely affected.

Yet another object is to provide a bead bypass system with a minimum amount of advancing surface by slowing or stopping at least one surface during the actual bead bypass which occurs when the surfaces are separated or approaching separation. In some modes and for some uses of the instant invention, both surfaces may be slowed down or stopped when the surfaces are separated.

The foregoing objects and others are accomplished in accordance with this invention by a system employing at least one separation roller continuously contacting the outside surface of a web and tracked to move in a fixed approximately elliptical path, for compensating for web motion during separation of the web from another surface to enable a bead of accumulated material built up at the line of contact between the web and the other surface to pass therebetween without changing the web velocity. During the separation period, the advancing velocity of at least one surface is reduced so that at least one surface is advanced at a slower rate than its rate prior to separation, or stopped. In a preferred embodiment, the system is employed in photoelectrophoretic imaging to bypass a bead of imaging suspension built up at the imaging nip during separation of two webs immediately after completion of imaging to thereby permit dissipation or passage of the liquid bead without changing the advancing web velocity by reason of the separation operation. During the separation period, the surface, preferably a web, which does not carry the desired image, is advanced at a slower rate than its prior rate and slower than the other surface, or stopped.

DESCRIPTION OF THE DRAWINGS

These and other objects and advantages of velocity compensating bead bypass systems and their use in improved photoelectrophoretic imaging systems will become apparent to those skilled in the art after reading the following detailed description taken in conjunction with the accompanying drawings wherein.

DESCRIPTION OF THE PREFERRED EMBODIMENTS

The invention, herein, is described and illustrated in specific embodiments having specific components listed for carrying out the functions of the apparatus. Nevertheless, the invention need not be thought of as being confined to such specific showings and should be construed broadly within the scope of the claims. Any and all equivalent structures and methods known by those skilled in the art can be substituted for the specific apparatus and methods disclosed as long as the substituted method and apparatus achieve a similar function. It may be that other methods and apparatus would be invented having similar needs to those fulfilled by the method and apparatus described and claimed herein, and it is the intention herein to describe an invention for use in apparatus other than the embodiment shown. For example, the invention hereof can be used in apparatus to separate the web from a drum or flat plate surface or any system or device wherein it is desirable to separate a web from another surface to allow for the dissipation of a bead of accumulated material built up at the line of contact between the surfaces.

Figure 1:
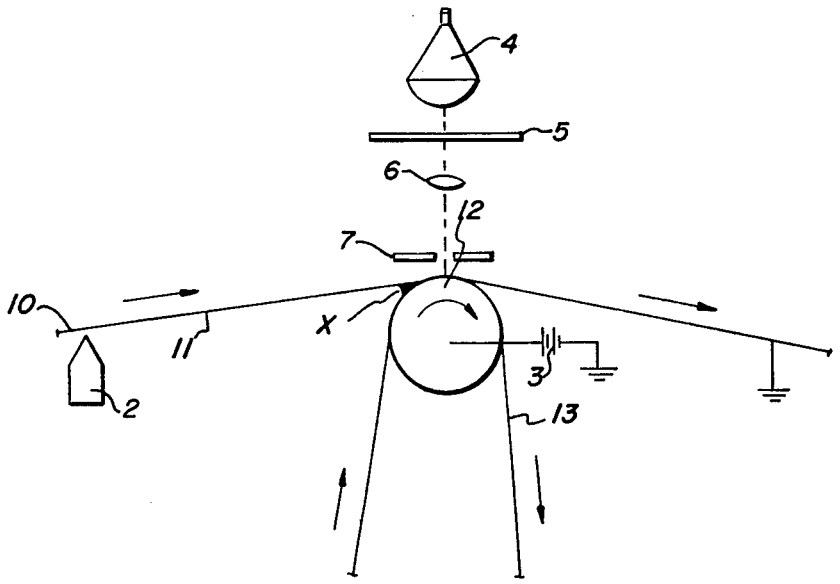
FIG. 1 is a side view, partially schematic drawing of a photoelectrophoretic imaging apparatus arrangement in which the accumulated bead problem arises.

Referring now to FIG. 1, there is shown a portion of photoelectrophoretic imaging apparatus for illustrating the problem of web separation which commonly arises in photoelectrophoretic web device imaging systems. The actual process steps of the web device configuration are basically the same process steps as used in photoelectrophoretic imaging systems described in patents referred to earlier and are incorporated by reference herein. The present description will be directed in particular to elements forming part of, or cooperating more directly with the present invention, elements of the photoelectrophoretic apparatus not specifically shown or described herein being understood to be selectable from those known in the art.

Still referring to FIG. 1, the web 13, referred to as the blocking web, is formed of an about 1 mil clear polypropylene blocking material. The web 10, referred to as the injecting web, is formed of an about 1 mil Mylar, a polyethylene terephthalate polyester film from DuPont, overcoated with a thin transparent conductive material, e.g., about 50% white light transmissive layer of aluminum. The conductive surface of the injecting web 10 is connected to ground at some convenient location within the system. As will be made clear from the explanation that will be given below, by analogy, the functions of the injecting web and the blocking webs correspond to the functions of the injecting and blocking electrodes respectively, described in great detail in the four patents referenced earlier. Although a web is preferred as the blocking electrode in this invention, the blocking web may also take the form of a drum, a flat surface of a reusable endless belt electrode. The web device inking system includes an inker (not shown) which supplies a metered flow of ink that will provide a uniform ink coating of the desired thickness on the conductive side of the injecting web 10. In one instance, an about 14 inch film length ink layer is coated onto the injecting web 10 at about 1.25 mils ink film thickness.

When the photoelectrophoretic imaging apparatus is not in operation or at rest, the injecting web 10 and blocking web 13 are separated from each other in the retracted position. At the start of the imaging cycle, the injecting web 10 is driven in the direction of the arrow by a mechanical drive, not shown, which accelerates web 10 to a constant speed between 3–20 inches per second, preferably about 5 inches per second, and the blocking web 13 is driven by an independent drive (not shown) in the direction of the arrow at a constant speed to match the speed of the injecting web 10. The outside surface of the blocking web 13 is entrained around the imaging roller 12 and the inside surface of the web 10 is initially out of contact with the web 13 and at the desired time is moved downward bringing the webs into contact forming a nip at the imaging roller 12. The web 10 carries a liquid coating of photoelectrophoretic ink or suspension which is at least intermittently applied to side 11. After the webs have been moved into contact, the layer of ink film is carried into the nip at roller 12 forming an ink-web sandwich at the nip. When the two webs are brought together to form the ink-web sandwich at the nip, which in photoelectrophoretic imaging systems may be at the imaging zone, the roller 12 formed, for example, of steel or conductive rubber, may be utilized to apply a uniform electrical imaging field across the ink-web sandwich. As the coating of ink is carried into the nip at roller 12, at least a portion of the liquid remains trapped at the entrance to the nip. Also, the combination of the pressures exerted by tension of the injecting web and the electrical field across the ink-web sandwich at the imaging roller 12, tends to cause excess liquid suspension to be uniformly metered out of the sandwich, forming a liquid bead generally designated as X, at the inlet to the imaging nip. This liquid bead X will remain in the inlet to the nip after the coated portion of the web has passed, and will then gradually dissipate through the nip. If a portion of the bead remains in the nip until the subsequent ink-film arrives, it will mix with this film and may thereby tend to degrade the subsequent images to be formed. One method for avoiding the degrading of images from this effect would be to simply allow lengths of web materials, not coated with suspension, to pass through the imaging zone, after liquid bead build-up, sufficient to allow all traces of the bead to pass before an imaging sequence is repeated. This method would entail a time delay between images and would also result in a great deal of waste of web material.

In order to dissipate or eliminate the bead, it is necessary to displace intermittently any or all of the three members of the two webs 10 and 13 and the roller 12 so as to reduce the wrap of outer web 10 to at least 0° or to disengage the outer web 10 from contact with the web 13, thus permitting the excess liquid bead to pass through the nip and be carried away by web portions not to be imaged. The wrap angle of the inner web 13 may be varied as long as it remains substantially greater than that of the outer web 10.

Figure 2:
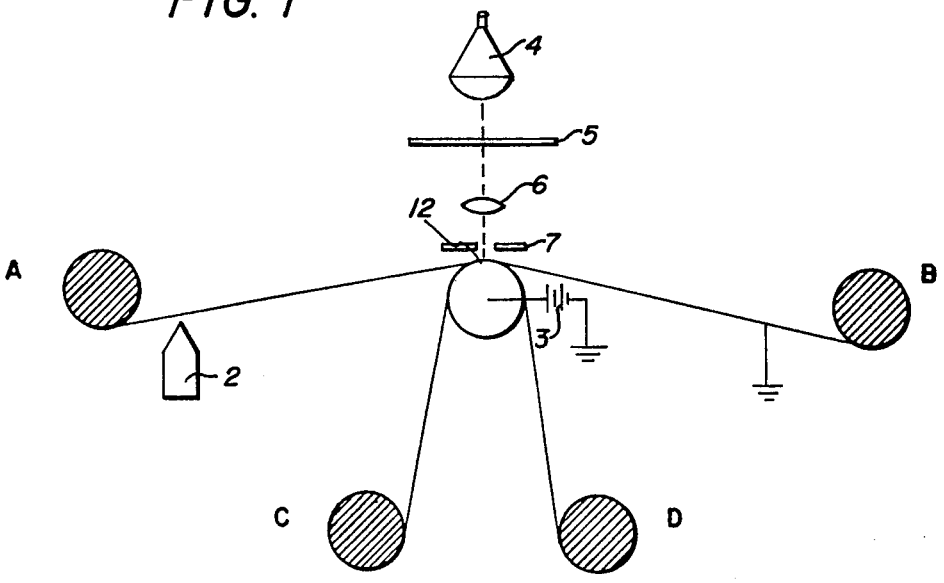
FIG. 2 is a side view, partially schematic drawing for explaining the problem of web separation in photoelectrophoretic imaging apparatus.

Referring to FIG. 2, two further conditions must be maintained for proper operation of the entire process during separation and contacting of the webs. First, the advancing velocity of the webs through the device must not be altered. Secondly, the relative velocity of the webs while they remain in contact with each other must be zero. FIG. 2 illustrates these two conditions. The webs 10 and 13 are shown as being stationary and each securely anchored at both ends to fixed non-rotating rollers A and B, and between fixed non-rotating rollers C and D, respectively.

One improved method for avoiding the degrading of images caused by the accumulation of excess bead material is described in copending application Ser. No. 476,189, Bead Bypass by Herman A. Hermanson, assigned to a common assignee. In the Hermanson application, apparatus is employed to separate two surfaces momentarily immediately after completion of imaging to permit the passage of the liquid bead between image frames. In one mode of operation, separation of the web from another surface is accomplished by disengaging the movable web from the surface. The disengagement of the web from the surface may tend to interrupt or change the advancing velocity of the web and, in the case of some photoelectrophoretic imaging systems wherein process steps are carried out rather simultaneously or in a timed sequence, interference with web advancing velocity (or length) would be undesirable.

A solution to the problem of changed web velocity during separation is disclosed in the copending application Ser. No. 476,188, Motion Compensation For Bead Bypass, by Roger G. Teumer, Earl V. Jackson and LeRoy Baldwin, assigned to common assignee. In one embodiment, the existing roller 12 is moved downward and an additional separator roller, located adjacent the injecting web 10, is moved upward at the same time to maintain a taut condition in the injecting web 10 during separation and downward during the contacting of the webs. Two rollers adjacent the blocking web move generally outward during separation and inward during contacting to maintain a taut condition in the blocking web 13 and to meet the condition of no relative slip between the webs. In practice, both the path and the velocity characteristics of the motion of the imaging roller 12 may be more or less arbitrarily determined. It is also possible to more or less arbitrarily choose the path of motion of the three added rollers, however, the velocity characteristics of the motions of these three rollers must be strictly controlled in timed relation to the motion of the roller 12.

In another embodiment of the Teumer et al application above, the existing roller 12 is maintained in a fixed position eliminating any need for displacement or compensation of the blocking web 13. Pressure and separation rollers are added, one on opposite sides and adjacent to the injecting web 10, are utilized to displace the injecting web 10 and maintain a taut condition. In this instance, the path and velocity characteristics of the motion of the separator roller may be more or less arbitrarily determined so as to achieve separation of the webs. The path of motion of the pressure roller which is maintained in contact with the outside surface of the web 10, may also be more or less arbitrarily chosen, but its velocity characteristics must be strictly controlled in timed relation to the motion of the separator roller in order to continuously maintain a taut condition of the injecting web 10.

Figure 3:
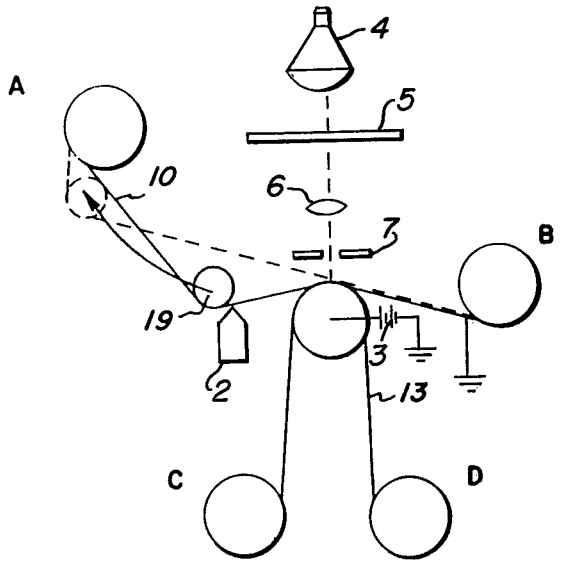
FIG. 3 is a side view, partially schematic drawing of the preferred embodiment of this invention.

Referring now to FIG. 3, there is shown a side view, partially schematic of the preferred embodiment of an improved solution to liquid bead accumulation. In this embodiment, only one moving compensation roller is used to disengage the webs from contact during separation, and it moves generally along the path shown by the arrow. In contrast to the previous approaches in liquid bead dissipation, the path of motion for the compensation roller 19 may not be arbitrarily chosen and once an initial position is chosen, there is only one correct path of motion which will maintain a taut condition in the web 10 while providing separation. The path of travel for the compensation roller 19 will be approximately elliptical in shape as taken from the side view. The velocity characteristics of the motion, however, need not be strictly controlled and the motion could be generated by any convenient means, e.g., rotating crank and connecting rod or pneumatic cylinder. A further advantage of this arrangement results from the location of the moving compensation roller 19 on the dry or uncoated side of the injecting web 10. Considering the typical photoelectrophoretic web wherein a liquid coating is at least intermittently applied to the injecting web, timing of the motion of the compensation roller 19 need not be constrained by the need to avoid contacting this coating, as would be the case in arrangements wherein the separator is moved into contact with the coated side of the injecting web. Other advantages may also be realized in terms of the spacing of machine components and in the amount of web material required between coatings.

Figure 4:
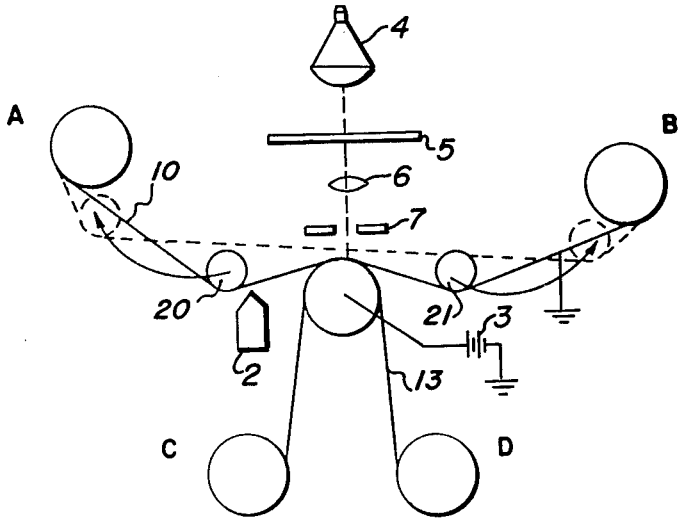
FIG. 4 is a side view, partially schematic drawing of an alternative preferred embodiment of this invention.

Referring now to FIG. 4, there is shown an alternative preferred embodiment of this invention. In this embodiment, two compensation rollers 20 and 21 are used, and the requirements for their motion are exactly as described for roller 19 in FIG. 3. The compensation rollers 20 and 21 may be moved concurrently or sequentially, they must, however, both be in their respective final positions in order to achieve the full reduction of wrap angle to 0° or, preferably, actual separation of the webs. Thus, there is a required positional relationship which must exist between the motions of the two compensation rollers 20, 21. Although the FIG. 4 embodiment of the invention requires an additional compensation roller, there may be a small advantage in this arrangement in that the motions of the two rollers 20 and 21 may be shorter than that of the single roller 19 in the FIG. 5 embodiment, thus, a particular machine arrangement may find this advantage important.

Figure 5:
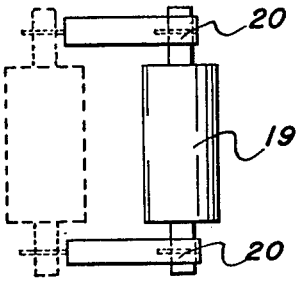
FIGS. 5 and 6 are side views, partially schematic drawings of photoelectrophoretic imaging apparatus for illustrating a detail according to this invention.
Figure 6:
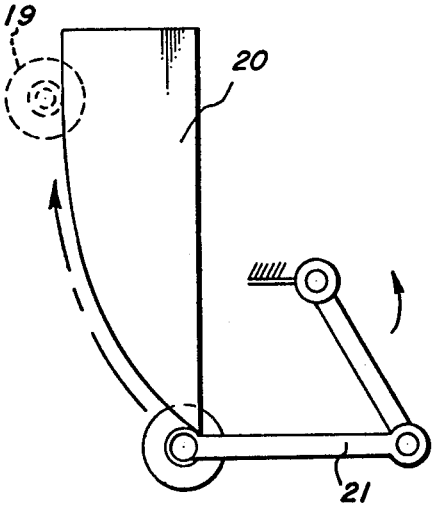
Figure 6:
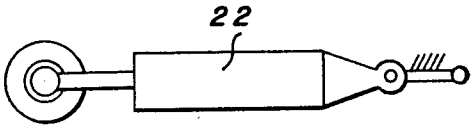

Referring now to FIGS. 5 and 6, there is shown a detail of the FIG. 3 embodiment of this invention. As recalled, the path of travel for the compensation roller 19 must be strictly controlled in order to achieve both web separation and motion compensation. During separation, the advancing rate for the injecting web remains constant primarily due to the controlled upward path taken by the compensation roller 19 which compensates for any slack or jerky motion which might otherwise occur in the web. This compensation motion is also provided in a reverse sequence during the return or downward path of the roller 19. Thus, the web 10 length and advancing rate of velocity remains constant during separation and the contacting of the webs and this is important to other process steps within the system which may be occurring simultaneously or in a timed sequence.

The cam-like groove or track 20 is provided to control the path of motion taken by the compensation roller 19. One surface of the cam 20 defines the elliptical path taken by the roller 19. The motion for the roller 19 may be generated by the rotating crank and connecting rod means 21 or, alternatively, by the pneumatic cylinder 22.

During the period when the webs are separated out of contact with each other, the advancing velocity of the injecting web remains constant and the velocity of the blocking web may be shifted from the imaging mode to a reduced standby mode or stopped automatically in order to conserve blocking web material. The advancing rate of the blocking web may be reduced to variable speeds or stopped between imaging frames during continuous operation and during non-continuous operation, the blocking web may be stopped completely during the period when the webs are out of contact with each other at the nip in the imaging zone. As the separator roller begins to move upward to separate the webs, the arm or lifter which mounts the roller, automatically actuates a micro-switch abutting the arm as the arm begins to move as a result of the camming action. When the photoelectrophoretic imaging device is operated continuously, i.e., to reproduce a series of images, the micro-switch is coupled to a variable potentiometer which in conjunction with control means decreases the level of the magnitude of voltage supplied to the blocking web drive motor when the webs are separated thereby reducing the advancing rate of the blocking web to a standby speed or stopping it, and increases the amount of voltage when the webs are brought into contact so that the blocking web is advanced at the imaging or process speed. Alternatively, a cam bank logic control means may be used to automatically reduce the advancing rate of the blocking web when the webs are out of contact with each other. In the case when the photoelectrophoretic imaging device is operated non-continuously, i.e., a single image is reproduced, the micro-switch is coupled to the blocking web drive supply and when actuated turns off the power supplied to the blocking web drive thereby stopping the blocking web completely.

After the ink-web sandwich has been subjected to the electrical field, exposed and the web separation sequence completed, the positive image is formed on the injecting web and the negative image is formed on the blocking web. The blocking web, which carries the negative image, may be rewound onto the take-up reel and disposed of. The injecting web, which carries the formed positive image, is carried into contact with a copy web entrained around the transfer roller at the transfer zone. Once the image has been transferred to the copy web, additional motion compensating bead bypass apparatus, identical to that used in the imaging zone, is utilized to separate the injecting web from the copy web to allow any excess liquid bead material that may build up at the line of contact between the webs to dissipate. During the transfer process motion compensating bead bypass apparatus functions in the same manner as in the imaging zone so that during the separation and the contacting of the webs at the transfer zone, the advancing rate of velocity of the webs at the transfer zone remains constant.

Thus, the originally projected image is substantially reproduced on the copy web without defects that may be caused by the accumulation of excess liquid material at the photoelectrophoretic imaging and transfer nip.

Other modifications of the above-described invention will become apparent to those skilled in the art and are intended to be incorporated herein.

What is claimed is:

1. A photoelectrophoretic imaging method comprising a. providing a pair of electrodes having inside and outside surfaces, wherein one of said electrodes is a web;

b. coating a layer of an imaging suspension comprising electrically photosensitive pigment particles in an electrically insulating carrier liquid on at least a portion of the inside surface of at least one of said electrodes before the inside surfaces of said electrodes are brought into contact with each other to form a nip;

c. advancing successive portions of the inside surfaces of said electrodes into contact with each other to form a nip, wherein a bead of accumulated imaging suspension forms at the entrance to the nip;

d. applying an electrical field across the imaging suspension between said electrodes;

e. exposing said suspension at the nip to an imagewise pattern of activating radiation at least when the inside surfaces of said electrodes are in contact at the nip with the suspension therebetween;

f. advancing at least said web electrode relative to the nip region so that at least the bead of accumulated imaging suspension is advanced beyond the nip region when the inside surfaces of the electrodes are separated;

g. separating the inside surfaces of said electrodes at the nip to a spacing sufficient to allow the bead of accumulated imaging suspension to pass the nip region;

h. compensating for motion during said separating step (g) whereby the advancing rate of velocity for said web electrode remains constant by moving at least one roller, always in continuous contact with the outside surface of said web electrode, in a fixed approximately elliptical path which always causes reduction of the wrap angle formed by said advancing web electrode in contact with said other electrode to cause separation of the inside surfaces of said electrodes without changing the advancing velocity of the web electrode; and i. reducing the advancing velocity of said other electrode when the inside surfaces of said electrodes are being separated or while they are separated whereby said other electrode is advanced at a slower velocity than its prior velocity.

2. A method according to claim 1 wherein at least one of said electrodes is transparent and wherein said imagewise exposure is through said transparent electrode.

3. A method according to claim 2 wherein said web electrode is an injecting electrode and is the transparent electrode and said other electrode is a web and is a blocking electrode, said blocking electrode being the electrode which is slowed or stopped during separation or while said inside surfaces of said electrodes are separated.

4. A method according to claim 3 including the step of re-contacting the inside surfaces of said electrodes and equalizing their advancing rates at the nip.

5. A method according to claim 4 wherein said rate of advancement of the two electrodes with the imaging suspension therebetween at the nip when in contact is between about 3 to about 20 inches per second.

* * * * *